US010458289B2

(12) United States Patent
Hanshaw et al.

(10) Patent No.: US 10,458,289 B2
(45) Date of Patent: Oct. 29, 2019

(54) SYSTEM AND METHOD FOR A PHASE CONTROL APPARATUS OF A CAM TIMING SYSTEM

(71) Applicant: Ford Global Technologies, LLC, Dearborn, MI (US)

(72) Inventors: Jamie Charles Hanshaw, South Lyon, MI (US); Luke Brodbeck, Brighton, MI (US); Andrew Erich Mast, Northville, MI (US); Shawn Kevin Carlisle, South Lyon, MI (US); Paul John Adam, Lasalle (CA); Joel John Beltramo, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 170 days.

(21) Appl. No.: 15/461,289

(22) Filed: Mar. 16, 2017

(65) Prior Publication Data

US 2018/0266285 A1 Sep. 20, 2018

(51) Int. Cl.

| | |
|---|---|
| ***F01L 1/34*** | (2006.01) |
| ***F01L 1/344*** | (2006.01) |
| *F01L 1/053* | (2006.01) |

(52) U.S. Cl.

CPC ..... *F01L 1/3442* (2013.01); *F01L 2001/0537* (2013.01); *F01L 2001/3443* (2013.01); *F01L 2001/34433* (2013.01); *F01L 2001/34459* (2013.01); *F01L 2001/34469* (2013.01); *F01L 2001/34496* (2013.01); *F01L 2201/00* (2013.01); *F01L 2250/02* (2013.01); *F01L 2820/041* (2013.01)

(58) Field of Classification Search

CPC ..... F01L 1/3442; F01L 2001/34459; F01L 2001/0537; F01L 2001/3443; F01L 2001/34433; F01L 2001/34469; F01L 2001/34496; F01L 2201/00; F01L 2250/02; F01L 2820/041

See application file for complete search history.

(56) References Cited

U.S. PATENT DOCUMENTS

| | | | | |
|---|---|---|---|---|
| 8,522,737 | B2 * | 9/2013 | Yokoyama | F01L 1/022 123/90.17 |
| 9,021,998 | B2 | 5/2015 | Moetakef et al. | |
| 2014/0130754 | A1 | 5/2014 | Moetakef et al. | |

* cited by examiner

*Primary Examiner* — Zelalem Eshete
(74) *Attorney, Agent, or Firm* — Geoffrey Brumbaugh; McCoy Russell LLP

(57) ABSTRACT

Methods and systems are provided for a phase control apparatus in a variable cam timing (VCT) system of an engine, the phase control apparatus having a locking pin coupled to a rotor vane and engageable with a locking pin recess in the phase control apparatus cover plate. In one example, a method for assembling the phase control apparatus may include positioning respective retarded side surfaces of the rotor vane and the housing in face-sharing contact while positioning respective retarded side surfaces of the locking pin and the locking pin recess in face-sharing contact and maintaining a backlash gap between only the advanced side surfaces of the locking pin recess.

11 Claims, 8 Drawing Sheets

SYSTEM AND METHOD FOR A PHASE CONTROL APPARATUS OF A CAM TIMING SYSTEM

FIELD

The present description relates generally to methods and systems for a variable cam timing system including a locking phase control apparatus.

BACKGROUND/SUMMARY

Variable cam timing (VCT) is used in engines to advance or retard intake and/or exhaust valve timing. Consequently, intake and/or exhaust valve timing may be adjusted based on engine operating conditions to increase combustion efficiency and decrease emissions, if desired. Additionally, engine power output may be increased across a wider range of engine operating conditions.

Locking mechanisms in VCT systems have been developed to lock the VCT system in a desired base configuration when there is insufficient oil pressure to operate the VCT system, such as during engine startup. Backlash, or a gap between components of the locking mechanism, are controlled to tight specifications. If this backlash is too tight sticking and binding issues may occur between locking components and if this backlash is too large it may lead to noise, vibration, and harshness (NVH) issues. Methods for setting a locking pin backlash for the locking mechanism includes either adjusting the backlash during a VCT actuator assembly process or controlling it within tightly controlled tolerances. However, as one example, controlling the backlash in the way during assembly may involve precise measurement techniques that require frequent re-calibration. This may increase the time and cost of assembly.

One example approach for a phase control apparatus is shown by Moetakef et al. in U.S. Pat. No. 9,021,998. Therein, a phase control apparatus is discloses that includes a locking pin coupled to a vane of a rotor, the locking pin extending into a locking pin recess disposed in a cover plate in a locked configuration. There is a locking pin backlash between the locking pin and locking pin recess, as well as VCT overtravel (e.g., an additional gap) disposed between the vane and housing of the phase control apparatus. Thus, in the locked configuration, a gap exists between the vane including the locking pin and the housing.

The inventors herein have recognized potential issues with such systems. As one example, due to the VCT overtravel disclosed above, when the locking pin is moved into the recess to locking the phase control apparatus, the vane may travel too far towards the housing and result in component wear between the locking pin and side of the locking pin recess as the locking pin extends into the locking pin recess. This may result in degradation of the components of the phase control apparatus over time and increased NVH issues. Additionally, assembly of such a phase control apparatus may be more difficult due to having to maintain the VCT backlash between the locking pin and locking pin recess and the VCT overtravel gap between the vane and housing.

In one example, the issues described above may be addressed by a method for assembling a phase control apparatus for an engine camshaft, comprising: positioning a vane of a rotor against a housing of a drive wheel of the phase control apparatus; positioning a locking pin of the vane against a first side of a recess disposed in a cover plate of the phase control apparatus; and maintaining a backlash gap between only the locking pin and a second side of the recess. In this way, a backlash gap (or VCT overtravel) may be eliminated between the vane of the rotor and the housing and only included between the locking pin and the second side or the recess, thereby increasing the ease of assembly and reducing component wear between the locking pin and the recess.

As one example, during engine operation, when a request is received to lock the phase control apparatus of the VCT system, a rotor of the phase control apparatus is rotated into a retarded cam position where a first surface of a vane of the rotor is in face-sharing contact with a first surface of a housing of the phase control apparatus. A locking pin of the vane of the rotor is then extended into a locking pin recess disposed within a cover plate coupled to a housing of the phase control apparatus. In the locked configuration, while the first surface of the vane is in face-sharing contact with the first surface of the housing, a first side of the locking pin is contacting a first side of the recess and a second side of the locking pin is spaced away from a second side of the recess, the first side of the recess arranged proximate to the first surface of the housing. Further, while in the locked configuration the locking pin may move within the recess. However, a gap between the first side of the recess and the locking pin may remain the same as a gap between the first surface of the vane and the first surface of the housing, even as the locking pin moves within the recess. This configuration of the phase control apparatus allows for easier locking of the apparatus during engine operation and reduced wear between the locking pin and locking pin recess. As a result, a longevity of the phase control apparatus may be increased and NVH issues due to component wear may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-9B are drawn approximately to scale, however other relative dimensions may be used if desired.

DETAILED DESCRIPTION

Figure 1:
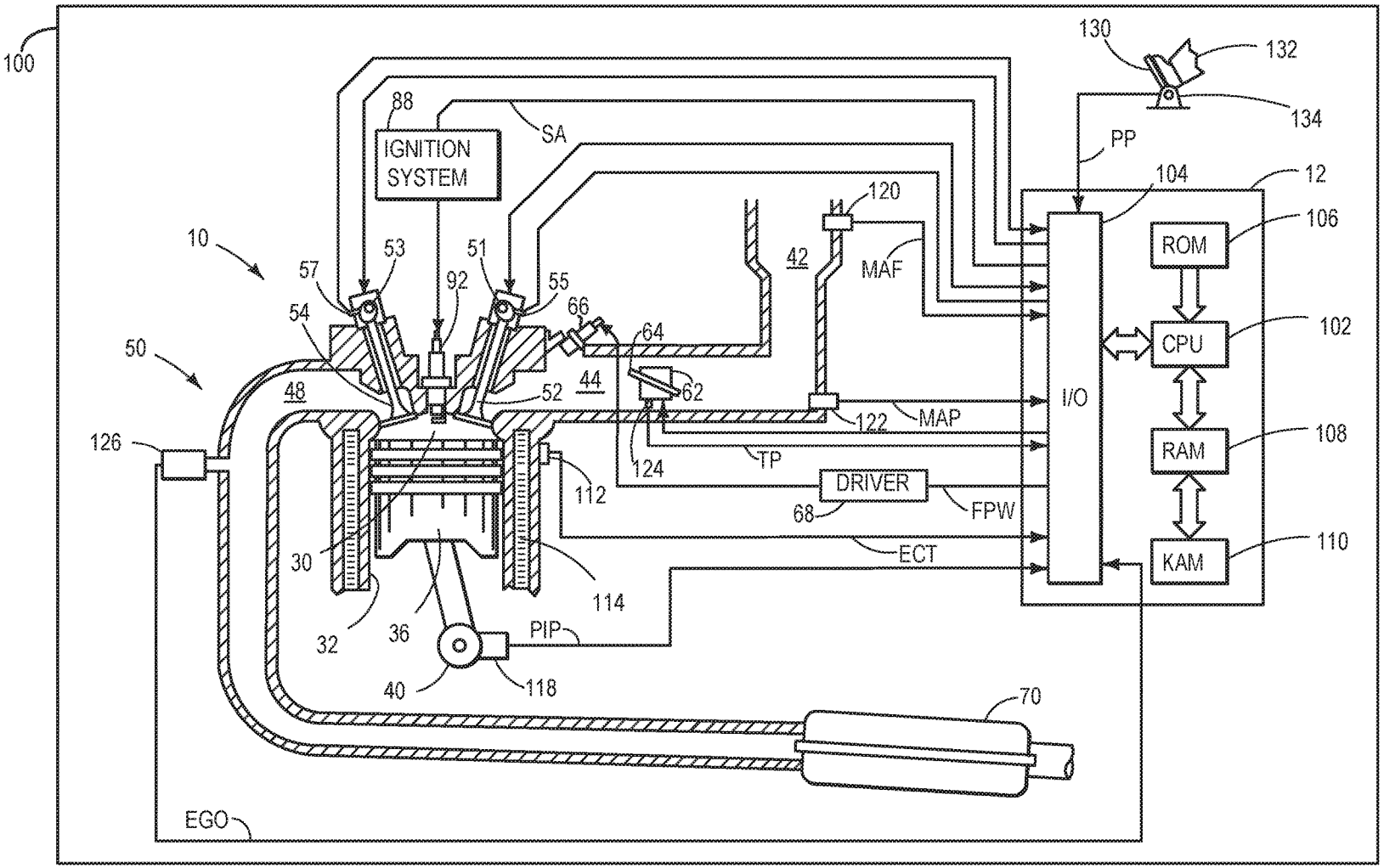
FIG. 1 shows a schematic depiction of an engine.
Figure 2:
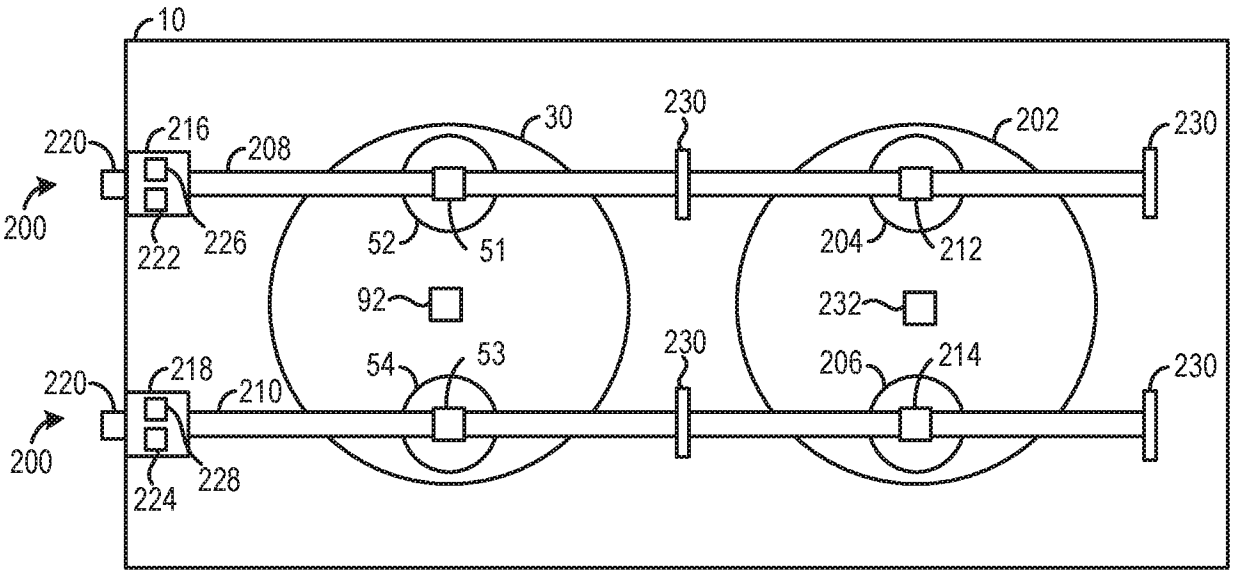
FIG. 2 shows another schematic depiction of the engine shown in FIG. 1 including a variable cam timing (VCT) system.
Figure 4:
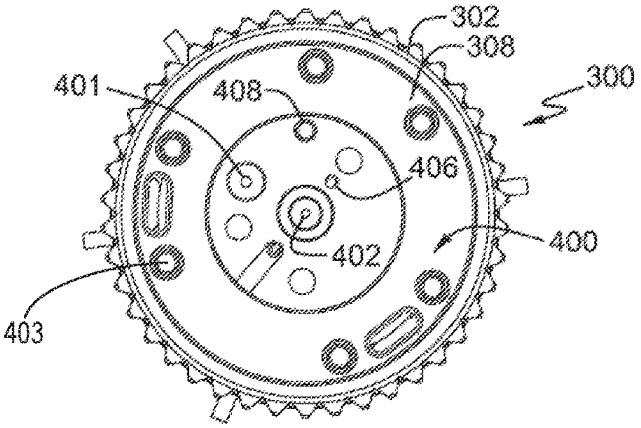
FIG. 4 shows a first end of the phase control apparatus.
Figure 5:
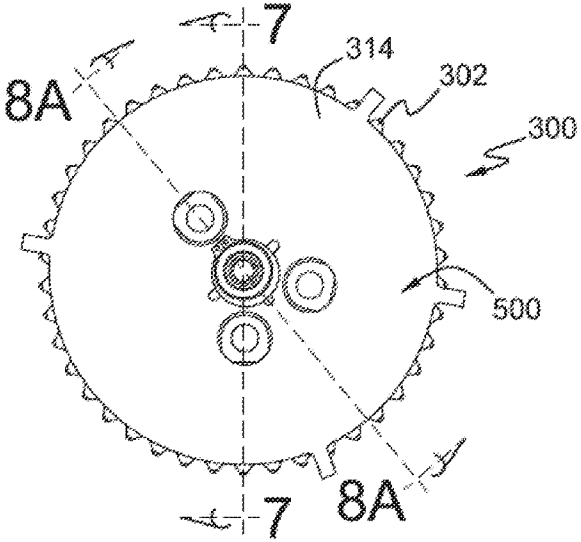
FIG. 5 shows a second end of the phase control apparatus.
Figure 3:
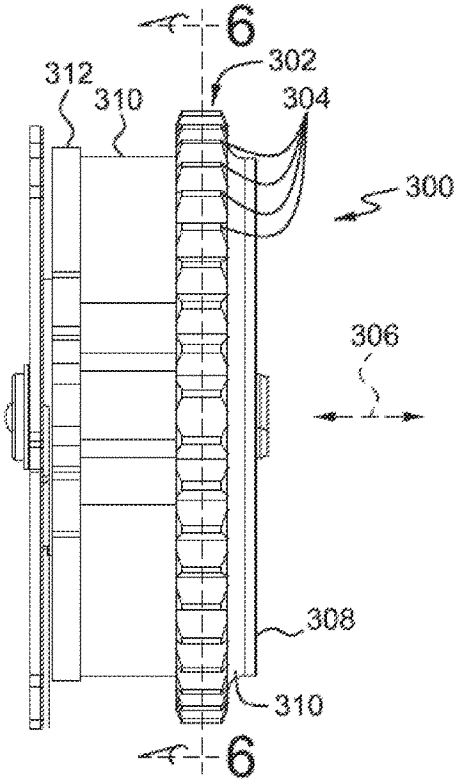
FIG. 3 shows a side view of a phase control apparatus included in the VCT system.
Figure 6:
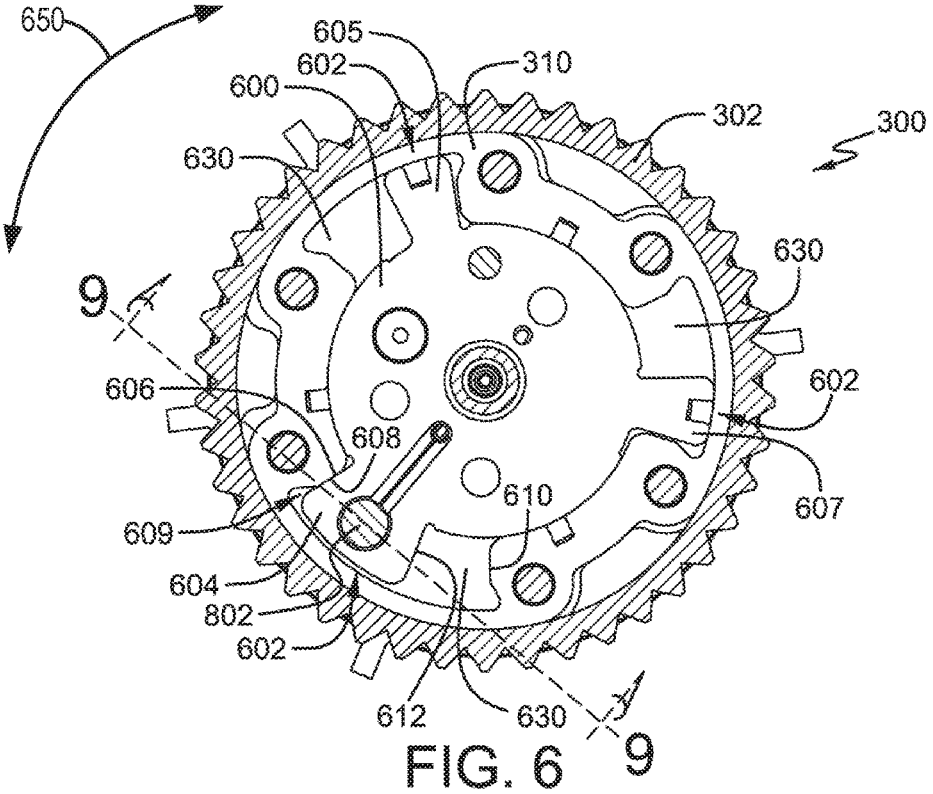
FIG. 6 shows the phase control apparatus in a locked configuration with an outer plate removed.
Figure 7:
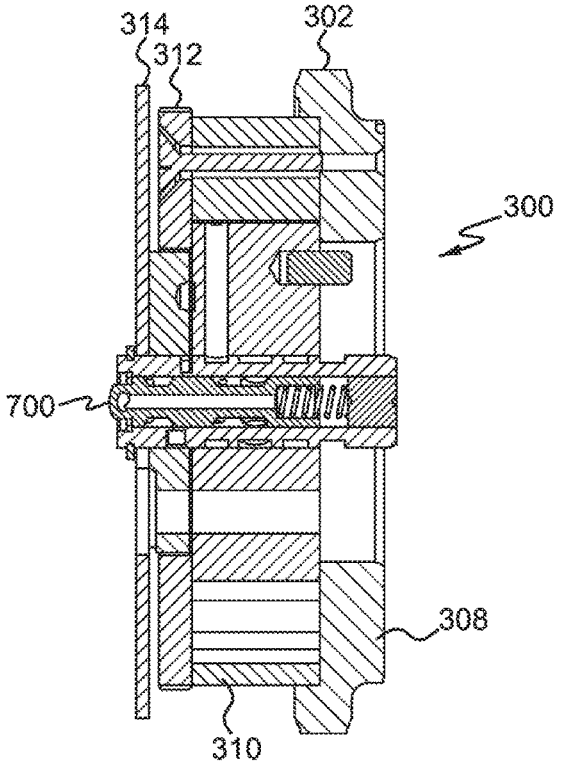
FIG. 7 shows a first, radial cross sectional view of the phase control apparatus through a central axis of a housing of the phase control apparatus.
Figure 8A:
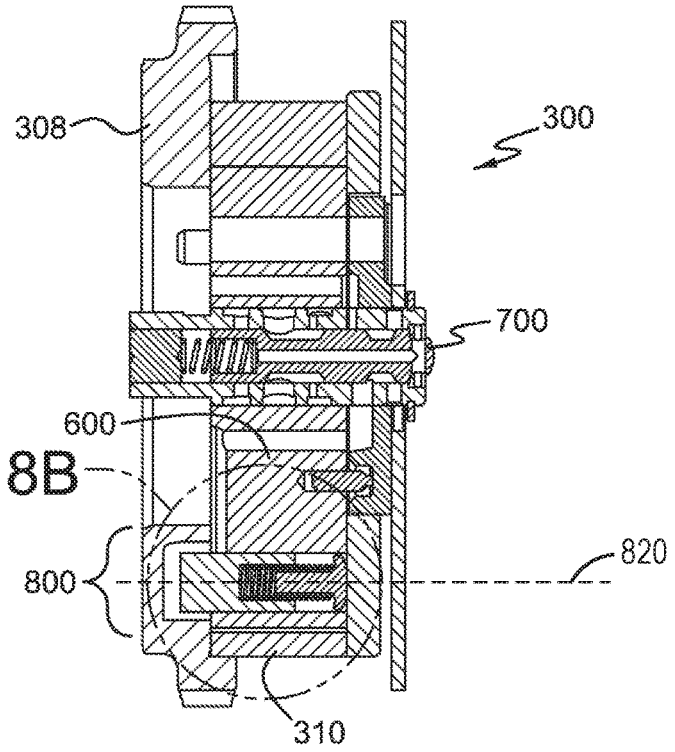
FIG. 8A shows a second, radial cross-sectional view of the phase control apparatus through a central axis of a locking pin of the phase control apparatus.
Figure 8B:
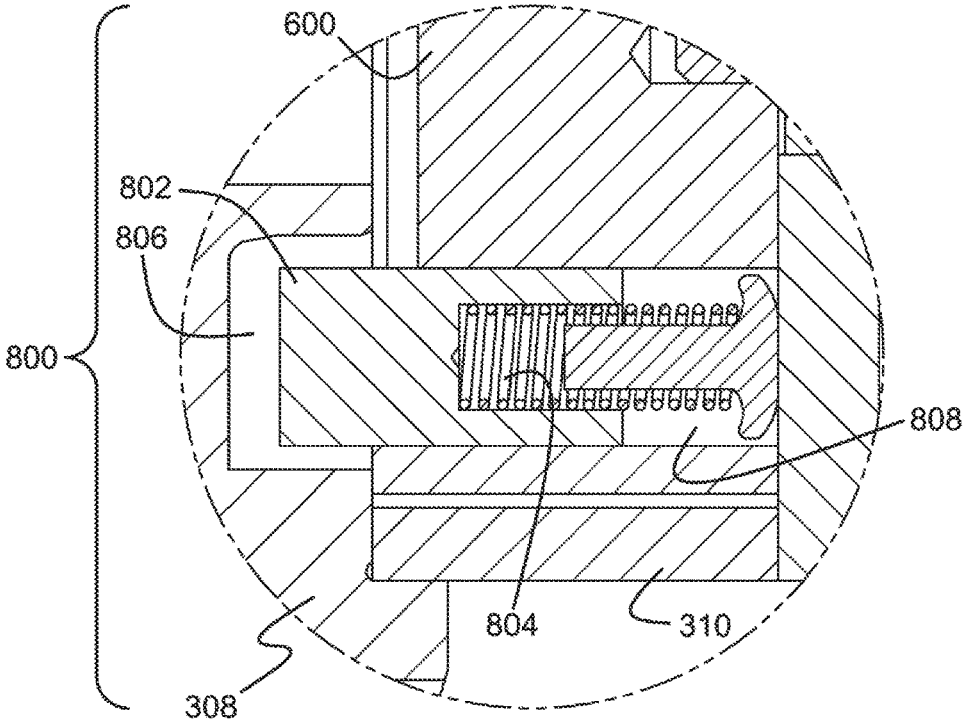
FIG. 8B shows a detail of the second cross-sectional view of the phase control apparatus through the central axis of the locking pin.
Figure 9A:
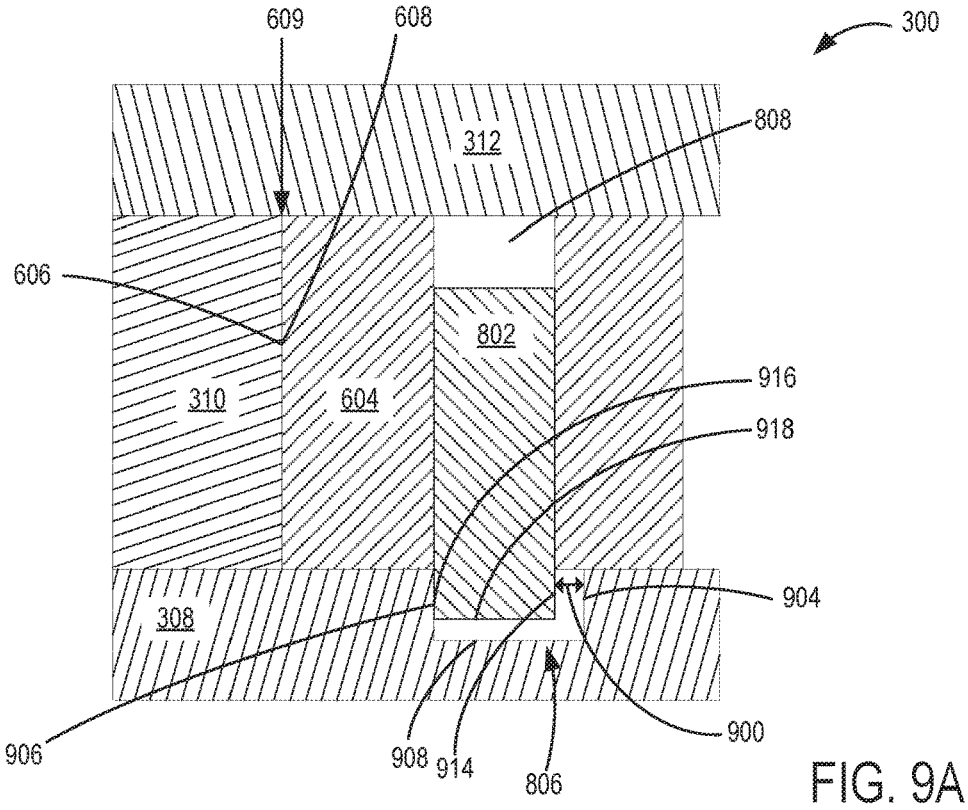
FIG. 9A shows a third, tangential cross-sectional view through the central axis of the locking pin of the phase control apparatus in a first locked position.
Figure 9B:
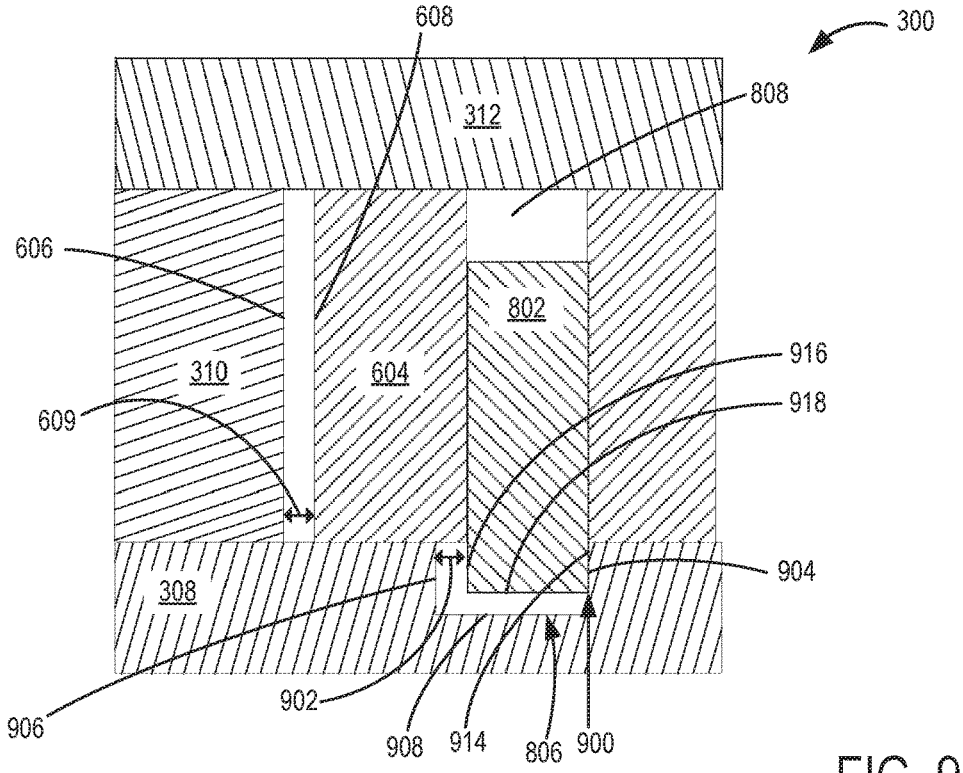
FIG. 9B shows the third, tangential cross-sectional view through the central axis of the locking pin of the phase control apparatus in a second locked position.
Figure 10:
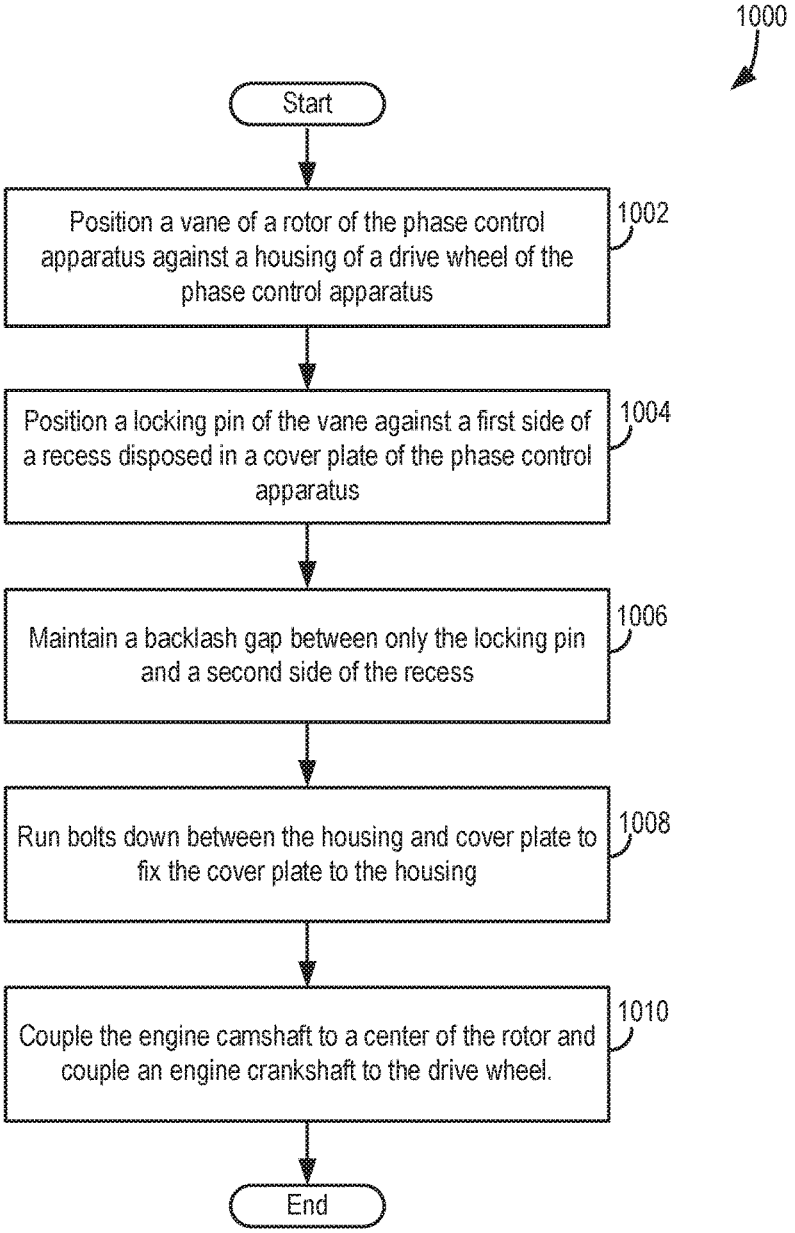
FIG. 10 shows a flow chart of a method for assembling a phase control apparatus of a VCT system.
Figure 11:
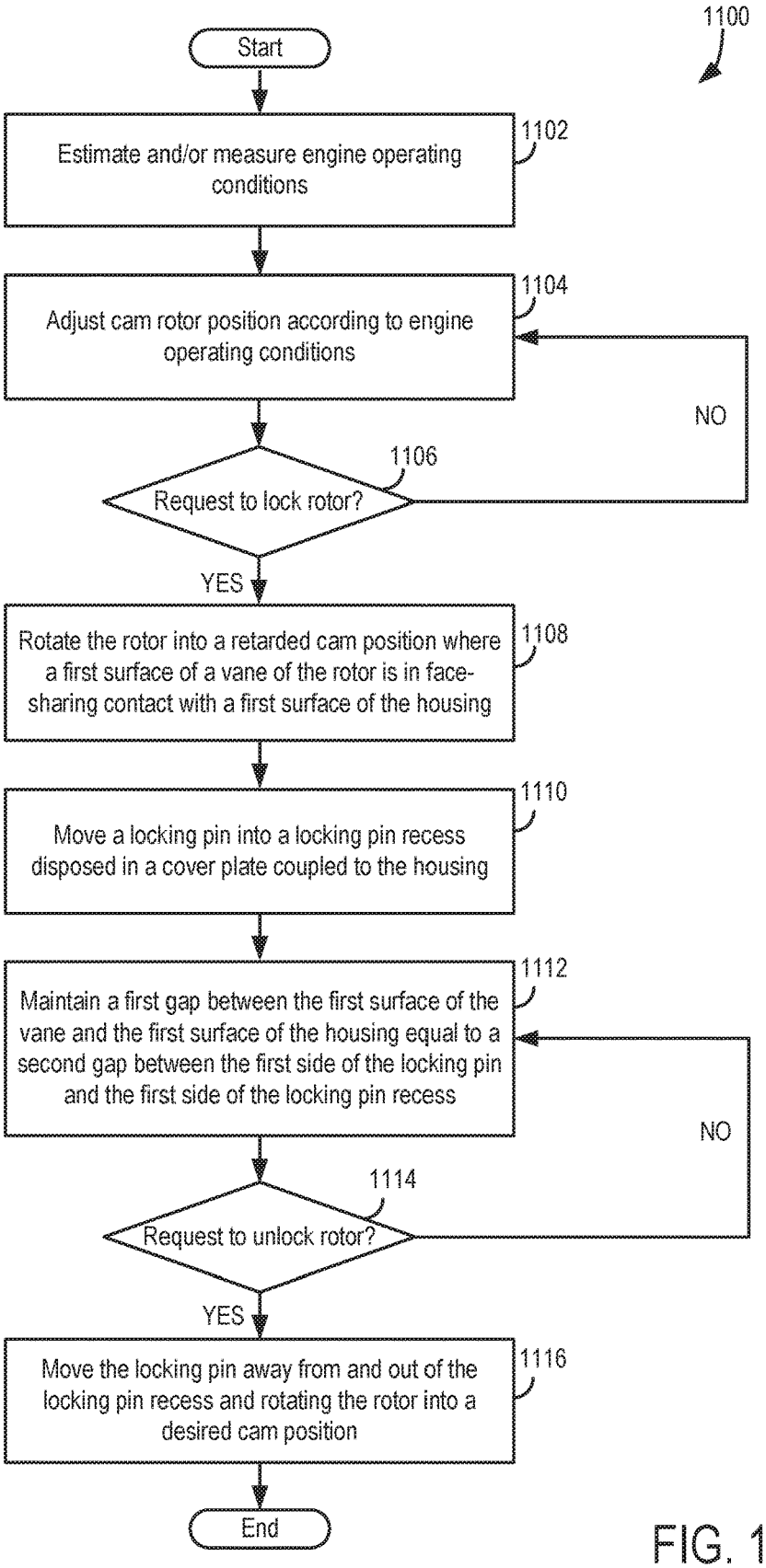
FIG. 11 shows a flow chart of a method for operating a phase control apparatus of a VCT system.

The following description relates to systems and methods for a phase control apparatus in a variable cam timing (VCT) system of a combustion engine, such as the example engine system shown in FIGS. 1-2. As shown in FIGS. 3-9B, the phase control apparatus may include a drive wheel that is rotatably coupled with a crankshaft of the engine, a cover plate covering a first side of the drive wheel and including a recess, a housing fixed to the drive wheel and positioned between the cover plate and an inner plate of the apparatus, and a vane rotor including at least one vane, positioned within the housing, and rotatably coupled to a camshaft. The vane may be positioned within a hydraulic chamber of the housing. Additionally, the vane may include a locking pin that may extend from the vane and into the recess of the cover plate to lock the phase control apparatus (e.g., lock rotation of the vane rotor relative to the housing). Example views of the assembled phase control apparatus including an outer plate are shown in FIGS. 3-5. The example view of the phase control apparatus with the outer plate removed in FIG. 6 shows the vane rotor coupled within the housing of the phase control apparatus, wherein the relative position of the vane(s) of the vane rotor and the housing may be adjusted to alter cam timing. In a locked configuration, when the locking pin is positioned within the locking pin recess, the vane may be spaced away from the housing in a hydraulic chamber, or the vane and the housing may be in face-sharing contact, in a circumferential direction. FIG. 7 shows a radial cross section of the phase control apparatus, taken along a radius of the phase control apparatus, including the outer plate, and FIG. 8A-8B show detailed radial cross sections of the phase control apparatus showing the locking pin and locking pin recess. When the locking pin of the phase control apparatus is in a locked position, it may be in a first locked position as shown in FIG. 9A, or a second locked position as shown in FIG. 9B, or any position therebetween. An assembly method for the phase control apparatus is presented at FIG. 10 which includes setting a locking pin backlash at assembly by ensuring that when the locking pin and locking pin recess are in face-sharing contact in the retarded position, the vane and the housing are also in face-sharing contact in the retarded position. This assembly method reduces the need for complex assembly processes to maintain manufacturing tolerances to set backlash, thereby decreasing manufacturing costs. A method for operating the phase control apparatus of the VCT system, which includes locking and unlocking the apparatus, is shown at FIG. 11. By eliminating overtravel, or an additional gap between the housing and the vane (e.g., the vane that includes the locking pin), component wear between the locking pin and locking pin recess may be decreased during operation of the phase control apparatus, thereby reducing NVH issues and increases a longevity of the phase control apparatus.

FIGS. 3-9B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

FIG. 1 is a schematic diagram showing one cylinder of a multi-cylinder engine 10, which may be included in a propulsion system of a vehicle 100 in which an exhaust gas sensor 126 (e.g., air-fuel sensor) may be utilized to determine an air fuel ratio of exhaust gas produce by engine 10. The air fuel ratio (along with other operating parameters) may be used for feedback control of engine 10 in various modes of operation. Engine 10 may be controlled at least partially by a control system including a controller 12 and by input from a vehicle operator 132 via an input device 130. In this example, input device 130 includes an accelerator pedal and a pedal position sensor 134 for generating a proportional pedal position signal PP. A cylinder (e.g., combustion chamber) 30 of engine 10 may include combustion chamber walls 32 with a piston 36 positioned therein.

Piston 36 may be coupled to a crankshaft 40 so that reciprocating motion of the piston is translated into rotational motion of the crankshaft. Crankshaft 40 may be coupled to at least one drive wheel of the vehicle via an intermediate transmission system. Further, a starter motor may be coupled to crankshaft 40 via a flywheel to enable a starting operation of engine 10. The crankshaft 40 may also be coupled to a VCT system described in greater detail herein.

Cylinders 30 may receive intake air from an intake manifold 44 via an intake passage 42 and may exhaust combustion gases via an exhaust passage 48. Intake manifold 44 and exhaust passage 48 can selectively communicate with cylinder 30 via respective intake valve 52 and exhaust valve 54. In some examples, cylinder 30 may include two or more intake valves and/or two or more exhaust valves. A throttle 62 including a throttle plate 64 is positioned in the intake passage 42. The throttle is configured to adjust the amount of airflow flowing to the cylinder 30. In this example, intake valve 52 and exhaust valves 54 may be actuated via an intake cam 51 and an exhaust cam 53. In some examples, the engine 10 may include a VCT system configured to adjust (e.g., advance or retard) cam timing. The position of intake valve 52 and exhaust valve 54 may be determined by position sensors 55 and 57, respectively.

A fuel injector 66 is shown arranged in intake manifold 44 in a configuration that provides what is known as port injection of fuel into the intake port upstream of cylinder 30. Fuel injector 66 may inject fuel in proportion to the pulse width signal FPW received from controller 12 via an electronic driver 68. In some examples, cylinder 30 may alternatively or additionally include a fuel injector coupled directly to cylinder 30 for injecting fuel directly therein, in a manner known as direct injection.

An ignition system 88 can provide an ignition spark to cylinder 30 via a spark plug 92 in response to spark advance signal SA from controller 12, under select operating modes. Though spark ignition components are shown, in some examples, cylinder 30 or one or more other combustion chambers of engine 10 may be operated in a compression ignition mode, with or without an ignition spark.

Exhaust gas sensor 126 is shown coupled to exhaust passage 48 of exhaust system 50 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. In some examples, exhaust gas sensor 126 may be a first one of a plurality of exhaust gas sensors positioned in the exhaust system. For example, additional exhaust gas sensors may be positioned downstream of emission control device 70.

Emission control device 70 is shown arranged along exhaust passage 48 downstream of exhaust gas sensor 126. Emission control device 70 may be a three way catalyst (TWC), NOx trap, various other emission control devices, or combinations thereof. In some examples, emission control device 70 may be a first one of a plurality of emission control devices positioned in the exhaust system. In some examples, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory 106 (e.g., memory chip) in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor 124; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses for each revolution of the crankshaft.

During operation, the cylinder 30 in the engine 10 typically undergoes a four stroke cycle: the cycle includes the intake stroke, compression stroke, expansion stroke, and exhaust stroke. In a multi-cylinder engine the four stroke cycle may be carried out in additional combustion chambers. During the intake stroke, generally, exhaust valve 54 closes and intake valve 52 opens. Air is introduced into cylinder 30 via an intake manifold, for example, and piston 36 moves to the bottom of the combustion chamber so as to increase the volume within cylinder 30. The position at which piston 36 is near the bottom of the combustion chamber and at the end of its stroke (e.g. when cylinder 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within cylinder 30. The point at which piston 36 is at the end of its stroke and closest to the cylinder head (e.g. when cylinder 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition devices such as spark plug 92, resulting in combustion. Additionally or alternatively compression may be used to ignite the air/fuel mixture. During the expansion stroke, the expanding gases push piston 36 back to BDC. A crankshaft may convert piston movement into a rotational torque of the rotary shaft. Finally, during the exhaust stroke, exhaust valve 54 opens to release the combusted air-fuel mixture to an exhaust manifold and the piston returns to TDC. Note that the above is described merely as an example, and that intake and exhaust valve opening and/or closing timings may vary, such as to provide positive or negative valve overlap, late intake valve closing, or various other examples. The valve timing may be altered by a VCT system discussed in greater detail herein. Additionally or alternatively compression ignition may be implemented in the cylinder 30.

FIG. 2 shows an example VCT system 200 included in the engine 10, also shown in FIG. 1. The VCT system 200 shown in FIG. 2 is configured to adjust the timing of both the intake and exhaust cams in the engine 10. However, in other examples, the VCT system may be configured to adjust the timing of the intake cams or the timing of the exhaust cams.

As shown the engine 10 includes the first cylinder 30, also shown in FIG. 1, and a second cylinder 202. However, it will be appreciated that the number of cylinders in the engine may be varied in other examples. For instance, the engine 10 may include four cylinders, in one example.

The cylinders are arranged in an inline configuration. That is to say that a flat plane extends through the centerline of each cylinder. However, other cylinder positions have been contemplated. The intake valve 52 and the exhaust valve 54 of the first cylinder 30 are shown. It will be appreciated that the valve may be positioned, respectively, in an intake port and an exhaust port. Likewise, an intake valve 204 and an exhaust valve 206 are coupled to the second cylinder 202. The intake valve 204 and the exhaust valve 206 are configured to open during combustion operation. Specifically, the intake valve 204 may enable fluidic communication between the second cylinder 202 and the intake manifold 44, shown in FIG. 1, in an open configuration and inhibit fluidic communication between the second cylinder 202 and the intake manifold 44, shown in FIG. 1, in a closed configuration. Additionally, the exhaust valve 206 may enable fluidic communication between the second cylinder 202 and the exhaust passage 48, shown in FIG. 1, in an open configuration and inhibit fluidic communication between the second cylinder 202 and the exhaust passage 48, shown in FIG. 1, in a closed configuration.

The VCT system 200 may include an intake camshaft 208 and/or an exhaust camshaft 210. The intake camshaft 208 may include intake cam 51 and intake cam 212 coupled thereto. The intake cams 51 and 212 are configured to cyclically actuate the intake valves during combustion operation. Likewise, the exhaust camshaft 210 may include exhaust cam 53 and exhaust cam 214 coupled thereto. The exhaust cams 53 and 214 are configured to cyclically actuate the exhaust valves during combustion operation. It will be appreciated that the circumferential position of the intake and/or exhaust cams may vary to enable actuation of the intake and exhaust valves at different time intervals.

The VCT system 200 further includes a first phase control apparatus 216 (e.g., intake phase control apparatus) and a second phase control apparatus 218 (e.g., exhaust phase control apparatus). As shown, the first phase control apparatus 216 is coupled to the intake camshaft 208. Additionally, the second phase control apparatus 218 is coupled to the exhaust camshaft 210. The first and second phase control apparatuses may be configured to adjust the phase between the crankshaft 40, shown in FIG. 1, and the respective camshaft.

The VCT system 200 may further include mechanical linkage 220 coupling the crankshaft 40, shown in FIG. 1, to the camshafts (208 and 210). The first phase control apparatus 216 may be identical to the second phase control apparatus 218. An example phase control apparatus 300 is shown FIGS. 3-9B and described in greater detail herein. The phase control apparatus 300 shown in FIGS. 3-9B may be one of the first phase control apparatus 216 or the second phase control apparatus 218, shown in FIG. 2. However, in other examples the phase control apparatuses (216 and 218) may have dissimilar configurations.

The first phase control apparatus 216 may include a locking mechanism 222 generically depicted via a box. It will be appreciated that the locking mechanism may have a greater complexity which is discussed in greater detail herein. Likewise, the second phase control apparatus 218 may also include a locking mechanism 224. The locking mechanisms (222 and 224) may be identical, in one example. The locking mechanisms are discussed in greater detail herein with regard to FIGS. 3-9B.

The controller 12 (shown in FIG. 1) may be configured to control the VCT system 200 to advance or retard intake and/or exhaust valve timing. Specifically, the controller 12 may be electronically (e.g., wired and/or wirelessly) coupled to control valves 226 and 228 (e.g., solenoid valves) in the VCT system 200. The control valves 226 and 228 may be coupled to or integrated into their respective phase control apparatus. The control valves 226 and 228 may be configured to adjust the phase between the crankshaft 40, shown in FIG. 1, and a corresponding camshaft. Specifically, the control valves 226 and 228 may be oil control valves configured to hydraulically adjust the phase angle between the crankshaft 40, shown in FIG. 1 and a respective camshaft. Thus, the control valves 226 and 228 may receive oil from conduits in the engine. However, other suitable types of control valves have been contemplated.

Camshaft bearings 230 are coupled to the intake camshaft 208 and the exhaust camshaft 210. The camshaft bearings 230 are configured to support as well as enable rotation of the camshaft to which they are coupled. The spark plug 92 is also shown coupled to the first cylinder 30. A second spark plug 232 or other suitable ignition device may be coupled to the second cylinder 202.

FIGS. 3-9B show an example phase control apparatus 300. For example, FIGS. 3-9B show different views and cross-sections of the phase control apparatus 300. The phase control apparatus 300 shown in FIGS. 3-9B may be the first or the second phase control apparatus (216 and 218 respectively), shown in FIG. 2. Thus, the phase control apparatus 300 may be included in the VCT system 200, shown in FIG. 2.

FIG. 3 shows a side view of the phase control apparatus 300. The phase control apparatus 300 includes a drive wheel 302. Specifically, in the depicted example the drive wheel 302 is a sprocket. Therefore, the drive wheel 302 includes teeth 304, in the depicted example. However, other types of drive wheels have been contemplated. A rotational axis 306 of the phase control apparatus 300 is also depicted. The drive wheel 302 may be coupled to the crankshaft 40 shown in FIG. 1. Mechanical linkage 220, such as a chain, sprockets, etc., may be used to couple (e.g., rotationally couple) the crankshaft 40, shown in FIG. 1, to the drive wheel 302. Therefore, it will be appreciated that the drive wheel 302 and the crankshaft 40 may rotate in the same phase.

A vane rotor 600, shown in FIG. 6, included in the phase control apparatus 300 may be rotationally coupled to one of the camshafts (208 and 210), shown in FIG. 2. The relative angular position of the vane rotor 600 and the drive wheel 302 may be adjusted via the VCT system 200. In this way, the phase of the cams may be adjusted to alter valve timing. Cover plate 308 is coupled (e.g., fixedly coupled) to a housing 310 of the phase control apparatus 300. The housing 310 and/or cover plate 308 may be fixedly coupled to the drive wheel 302, in some examples. An inner plate 312 is also shown in FIG. 3. The cutting plane defining the cross-section shown in FIG. 6 is illustrated in FIG. 3.

FIG. 4 shows a first end 400 of the phase control apparatus 300. The cover plate 308 and the drive wheel 302 are shown. The cover plate 308 and the drive wheel 302 may be fixedly coupled to one another in some examples using a plurality of bolts 403. Thus, the cover plate 308 and the drive wheel 302 rotate in the same phase during engine operation when combustion cycles are being performed in some examples. In the depicted example, six bolts are shown, but more or less bolts may be used. In other examples, alternate methods of fixing the drive wheel to the cover plate may be used.

An oil inlet 401 is also depicted in FIG. 4. Oil from the oil inlet may be directed to chambers adjacent to vane rotor 600, shown in FIG. 6. Cam mounting openings (e.g., holes) 402 included in the phase control apparatus 300 are also depicted. The vane rotor 600 may attach to one of the camshafts (208 and 210), shown in FIG. 2.

The phase control apparatus 300 shown in FIG. 4 further includes an oil supply inlet 406 which allows hydraulic fluid to enter a locking pin recess 806 adjacent to locking pin 802 in order to actuate it, shown in FIGS. 8B and 9A-9B and discussed in greater detail herein. In one example, hydraulic fluid may enter the oil supply inlet 406 in order to exert an actuating force on the locking pin and move it out of the recess, to an unlocked position. In another example, the supply of hydraulic fluid may be discontinued to locking pin recess 806, allowing a spring 804 of the locking pin 802 to urge the locking pin into the locking pin recess 806. The phase control apparatus 300 shown in FIG. 4 further includes a locating pin 408. However, it will be appreciated that one or more of the aforementioned components may be omitted from the phase control apparatus 300 in other examples.

FIG. 5 shows a second end 500 of the phase control apparatus 300 including an outer plate 314 and the drive wheel 302. The cutting plane defining the cross-section shown in FIG. 7 is illustrated in FIG. 5, as well as the cutting plane defining the cross-section shown in FIG. 8A.

FIG. 6 shows a cross-sectional view of the phase control apparatus 300 including the housing 310. The housing 310 is fixedly coupled to the drive wheel 302. Thus, the housing 310 and the drive wheel 302 rotate in the same phase. Vane rotor 600 is also shown, fixedly coupled to a camshaft such as the intake camshaft 208 or the exhaust camshaft 210, shown in FIG. 2. The housing 310 at least partially encloses the vane rotor 600 and specifically a plurality of vanes 602 included in the vane rotor. Thus, the vane rotor 600 may be referred to as being positioned within the housing 310.

The vane rotor includes three vanes including a first vane 604, a second vane 605, and a third vane 607, in the depicted example. However, an alternate number of vanes may be used. In one example, the vane rotor 600 may include a single vane. In other examples, the vane rotor 600 may include four vanes. The vanes are housed in hydraulic chambers 630 of the housing 310.

The phase control apparatus 300 shown in FIG. 6 is in a locked configuration, where rotations of the vane rotor 600 is locked (e.g., relatively fixed so that the cam timing does not change) relative to the housing 310, as discussed in greater detail herein. On the other hand, when the phase control apparatus 300 is in an unlocked configuration, the relative position of the vanes 602 and the housing 310 may be adjusted via a control valve such as one of the control valves 226 and 228, shown in FIG. 2. In this way, the cam timing may be adjusted based on engine operating conditions. The controller 12, shown in FIG. 1 may be configured to send control signals to the control valve to trigger a cam timing adjustment and therefore is electronically coupled to the control valve.

Continuing with FIG. 6, the locked configuration of the phase control apparatus 300 includes when the locking pin 802 is inserted into locking pin recess 806, as shown in FIG. 8B. A surface 608 of vane 604 may be rotated toward or away from a surface 606 of housing 310 in a circumferential direction 650 (e.g., in a direction of rotation of the vane rotor, around the rotations axis 306) while the locking pin is inserted into the locking pin recess. Specifically, the vane may be rotated with respect to the housing from a position when the locking pin is contacting the locking pin recess on an advanced side of the recess to a retarded side of the recess or any position therebetween. In the depicted example, the surface 608 of vane 604 is in face-sharing contact (e.g., direct contact where gap 609 is zero) with surface 606 of housing 310. In other examples, the surface 608 of vane 604 may be rotated away (e.g., rotated away in a circumferential direction) from surface 606 of housing 310, increasing the size of gap 609. In one example, the gap 609 may be 0.15-0.35° angular rotation, which is determined by a backlash gap 900 set for the locking pin, the backlash gap 900 being between the locking pin 802 and the locking pin recess 806 as shown in FIG. 9A. Further detail regarding vane 604 rotation with respect to the locking pin recess 806 and the housing 310 will be presented with reference to FIGS. 9A-9B.

The surfaces 606 and 608 are correspondingly contoured in the depicted example. Specifically, the surfaces 606 and 608 are planar in the depicted example and therefore may be referred to as planar surfaces. However, other surface contours have been contemplated. The surface 606 of the housing 310 may correspond to a retarded cam timing position (e.g., fully retarded cam timing position). Therefore, when surface 608 is in face-sharing contact with surface 606, the phase control apparatus 300 may be in a retarded (e.g., fully retarded) cam timing position. Likewise, a second surface 610 of the housing 310 may correspond to an advanced cam timing position. Thus, when the second surface 610 of the housing 310 is in face sharing contact with a second surface 612 of the vane 604 the phase control apparatus 300 may be in an advanced cam timing position (e.g., fully advanced cam timing position). In this way, the housing 310 may define the advanced and retarded valve timing boundaries of the VCT system. The cutting plane defining the cross section shown in FIGS. 9A-9B is also illustrated in FIG. 6.

FIG. 7 shows another cross-sectional view of the phase control apparatus 300. A valve spool 700 is shown in FIG. 7. The valve spool 700 is configured to direct hydraulic fluid (e.g., oil) to certain portions of the phase control apparatus 300 for phase adjustment. In one example, the spool valve 700 may be centrally located, but it other examples it may be a remotely mounted spool valve. The inner plate 312, the outer plate 314, and the drive wheel 302 are also shown in FIG. 7. Additionally, the cover plate 308 and the housing 310 are also shown in FIG. 7.

FIG. 8A shows another cross-sectional view of the phase control apparatus 300. The valve spool 700, vane rotor 600, housing 310 and cover plate 308 are also shown. As previously discussed, the cover plate 308 is coupled to the housing 310. A locking mechanism 800 is also shown in FIG. 8A. The locking mechanism 800 may be one of the locking mechanisms 222 and 224 shown in FIG. 2. The locking mechanism 800 may be adjustable in a locked configuration in which the relative position of vane rotor 600 and the cover plate 308 and housing 310 are substantially fixed. FIG. 8A shows the locking mechanism 800 in a locked configuration. It will be appreciated that due to the tolerances (e.g., backlash gap, as described further below) in the locking mechanism 800 there may be small adjustments in the position between the vane rotor 600 and the cover plate 308 and housing 310 when the locking mechanism is in a locked configuration. FIG. 8A shows axis 820, which coincides with a central axis of the locking pin 802. It will be appreciated that in one example, axis 820 and axis 306, shown in FIG. 3, may be parallel.

An expanded view of the locking mechanism 800 is shown in FIG. 8B. The housing 310, cover plate 308, and vane rotor 600 are shown in the expanded view. Locking pin 802 included in the locking mechanism 800 is included in or coupled to the vane rotor 600. In the depicted example, locking pin 802 is cylindrically shaped, however other shapes have been contemplated. In other examples, locking pin 802 may include a biasing member (e.g., spring) 804. Specifically, spring 804 extends into the locking pin 802. However, in other examples, the spring 804 may be coupled to an exterior surface of the locking pin 802. The spring 804 may be fixedly coupled to a portion of the vane rotor 600. The spring 804 is configured to exert an axial force on the locking pin 802. In this way, the locking pin 802 may return to a locked position when hydraulic pressure or other actuating force exerted on the locking pin is discontinued. However, other actuation techniques have been contemplated. The locking pin 802 is positioned in a locking pin recess 806 included in the locking mechanism 800 in the locked configuration of the locking mechanism. The locking pin recess may be a formed void, with a rectangular, oblong, or cylindrical shape, however, other shapes have been contemplated. On the other hand, in an unlocked configuration, the locking pin 802 is moved in an axial direction such that the locking pin 802 is positioned external to the locking pin recess 806. That is to say, the locking pin 802 is positioned entirely within a bore 808 in the vane of the vane rotor 600. In the unlocked configuration, the relative position of the vane rotor 600 and the housing 310 may be hydraulically adjusted by a control valve (e.g., hydraulic control valve) included in the phase control apparatus 300, for example.

Hydraulic fluid (e.g., oil) may be used to actuate the locking mechanism 800 to an unlocked position. Specifically, hydraulic fluid may be directed into recess 806 to urge the locking pin 802 into the unlocked position, wherein the locking pin 802 slides axially along bore 808, in a direction away from the locking pin recess 806 and toward the inner plate 312, shown in FIG. 7.

FIGS. 9A and 9B show schematics of a cross-sectional view of the phase control apparatus 300 with the locking pin in a first position and a second position, respectively. The cross-sectional view is taken with the locking pin 802 positioned in the locking pin recess 806, along the cutting plane shown in FIG. 6. Spring 804 is not shown for clarity. The location of the locking pin 802 within the locking pin recess 806 may include: a first position, where a first (e.g., retarded) side surface 916 of locking pin 802 is in face-sharing contact with a first (e.g., retarded) side 906 of the locking pin recess 806; a second position, where a second (e.g., advance) side surface 914 of locking pin 802 is in face-sharing contact with a second (e.g., advance) side 904 of the locking pin recess 806; or any position therebetween. The first side 906 may be arranged opposite the second side 904, relative to a center, or central axis, of the locking pin recess 806. Further, the first side 906 may be positioned closer to the housing 310 (e.g., the surface of the housing 310 that contacts the vane 604, as described further below) than the second side 904.

FIG. 9A shows an example of the locking pin in the first locked position, where the first side surface 916 of locking pin 802 is in face-sharing contact (e.g., direct contact) with the first side 906 of the locking pin recess 806, and the second side surface 914 (arranged opposite the first side surface 916 relative to a center, or central axis of the locking pin) of locking pin 802 is spaced away (e.g., circumferentially spaced away in a circumferential direction, or direction of rotation of the vane rotor) from the second side 904 of the locking pin recess 806 forming gap (e.g., backlash or backlash gap) 900 between the second side surface 914 of the locking pin 802 and the second side 904 of the locking pin recess 806.

In some examples, there may exist a total gap threshold which comprises the summation of gap 609 and gap 900. In these examples, when the locking pin is in the first locked position, surface 608 of rotor vane 604 and surface 606 of housing 310, shown in FIG. 6, may be in face-sharing contact, resulting in gap 609 being zero and gap 900 may be equal to or less than the total gap threshold. Alternately, when the first side surface 916 of locking pin 802 is in face-sharing contact with the first side 906 of the locking pin recess 806, there may be a gap 609 that is greater than zero if gap 900 is less than the total gap threshold. In a non-limiting example, a total gap threshold of 0.40° angular rotation may exist for a VCT mechanism, where the total gap threshold is the combined total of gap 609 and gap 900. If, when the locking pin 802 is in the first locked position, gap 900 is 0.35° angular rotation and gap 609 is 0.03° angular rotation, then the combined total of gap 900 and gap 609 is 0.38° angular rotation. Because this is less than the total gap threshold of 0.40° angular rotation, NVH may be reduced or eliminated. In some examples, when the locking pin is in the first locked position, the gap 609 may not be larger than 0.03° angular rotation and thus may be 0.03° angular rotation or less. Additionally, by minimizing the size of gap 609 in this way, when the locking pin 802 is in a locked position, the only points of contact are between the locking pin 802 and the locking pin recess 806. As a result, wear may be reduced, and NVH may be reduced.

FIG. 9B shows an example of the locking pin in the second locked position, where the second side surface 914 of locking pin 802 is in face-sharing contact with the second side 904 of the locking pin recess 806. As the locking pin 802 and vane 604 moves from the first position to the second position, the gap 900 would decrease and approach zero as a second gap 902 would increase (e.g., increase proportionally with the decreasing gap 900) between the first side surface 916 of locking pin 802 and the first side 906 of the locking pin recess 806. In one example, gap 902 and gap 609 may be equal, regardless of locking pin position. When the locking pin 802 is in the second locked position, gap 609 may be the same dimension (e.g., size) as gap 902. In other words, the gap 902 formed between the first side surface 916 of the locking pin 802 and the first side 906 of the locking pin recess 806 may be equivalent to the gap 609 between the surface 608 of rotor vane 604 and surface 606 of housing 310 shown in FIG. 6.

It will be appreciated that when the locking pin 802 is in the first locked position as shown in FIG. 9A, backlash gap 900 may be equivalent to gap 902 and equivalent to gap 609 when the locking pin 802 is in the second locked position as shown in FIG. 9B.

Therefore, on the retarded side of the backlash range, between the locking pin and the locking pin recess, the vane and the housing may be in face-sharing contact, and on the advanced side of the backlash range, between the locking pin and the locking pin recess, the vane may be spaced away from the housing.

It will be appreciated that the locking pin 802 may move in an axial direction during locking and unlocking. During unlocking, for example, locking pin 802 may move in an axial direction along axis 820 shown in FIG. 8A. In other words, locking pin 802 may slide further into bore 808, in a direction away from locking pin recess 806. Specifically, the distance between a pin end 918 of locking pin 802 and a base 908 of locking pin recess 806 may increase. Controller 12, shown in FIG. 1, is configured to trigger adjustment of the locking mechanism 800. Turning now to FIG. 10, an example method 1000 for assembling a phase control apparatus for a VCT system is shown, such as the phase control apparatus 300 shown in FIGS. 3-9B. Method 1000 may occur prior to engine operation, while the phase control apparatus is being assembled (which may occur initially outside the engine).

At 1002, the method includes positioning a vane (e.g., vane 604 shown in FIGS. 6, 9A, and 9B) of a rotor (e.g., vane rotor 600 shown in FIGS. 6, 8A, and 8B) of a phase control apparatus (e.g., phase control apparatus 300 shown in FIGS. 3-9B) against a housing (e.g., housing 310 shown in FIGS. 3, 6-7, 8A-8B) of a drive wheel (e.g., drive wheel 302 shown in FIGS. 3-7) of the phase control apparatus. In one example, positioning the vane of the rotor of the phase control apparatus against the housing includes eliminating a gap between the housing and the vane of the rotor so that a surface of the housing has face-sharing contact with a surface of the vane rotor.

At 1004, the method includes positioning a locking pin (e.g., locking pin 802 shown in FIGS. 6, 8A, 9A-9B) of the vane against a first side of a locking pin recess (e.g., locking pin recess 806 shown in FIGS. 8B, 9A-9B) disposed in a cover plate of the phase control apparatus. In one example, the first side of the recess is arranged opposite the second side of the recess relative to a center of the recess and the second side of the recess is positioned farther away from where the vane is positioned against the housing than the first side of the recess. In another example, positioning the locking pin against the first side of the locking pin recess includes extending the locking pin from an aperture (e.g., bore) disposed in the vane into the recess, and further positioning the locking pin against the first side of the recess by biasing the locking pin against the first side of the recess and decreasing a gap (e.g., overtravel gap) between the housing and the vane of the rotor to zero. In one example, the locking pin recess has a first width and the locking pin is cylindrical and has a second diameter, the second diameter smaller than the first width.

At 1006, the method includes maintaining a backlash gap between only the locking pin and a second side of the recess. By maintaining a backlash gap only between the locking pin and a second side of the recess, overtravel (e.g., gap between the housing and the vane while the locking pin is in face-sharing contact with the first side of the recess) may be reduced (e.g., eliminated) thereby reducing the need for complex assembly methods for maintaining overtravel within manufacturing tolerances. In addition, by eliminating overtravel, ease of operation of the phase control apparatus is increased. For example, it may not be possible for the vane rotor to overtravel (e.g., overshoot) the locking pin recess when the locking pin moves to engage the locking pin recess, as is typical in configurations that include overtravel in addition to backlash gap. Overtravel of the locking pin recess may result in the locking pin colliding with the housing, causing increased wear and NVH. By eliminating the overtravel, the locking pin may more easily slide into the recess, without hitting a sidewall of the recess, thereby reducing component wear and NVH.

At 1008, the method includes running bolts down between the housing and cover plate to fix the cover plate to the housing. In this way, the cover plate and the drive wheel rotate in the same phase during engine operation when combustion cycles are being performed. In other examples, alternate methods of fixing the drive wheel to the cover plate may be used. Because the cover plate contains the locking pin recess, the relative location of the cover plate with respect to the drive wheel and housing, which is rotationally fixed to the drive wheel, determines the amount of overtravel present in the system. In other words, by tightening the bolts when the first surface of a vane is in face-sharing contact with a first surface of the housing and the first surface of the locking pin is in face sharing contact with the first side of the recess, overtravel may be reduced (e.g., eliminated, as explained above).

At 1010, the method includes coupling the engine camshaft to a center of the rotor and coupling an engine crankshaft to the drive wheel. In one example, the engine camshaft may be bolted to the center of the rotor. In other examples, coupling an engine crankshaft to the drive wheel may include a mechanical linkage such as a chain or sprockets to couple (e.g., rotationally couple) the crankshaft to the drive wheel.

Turning now to FIG. 11, an example method 1100 for operating a phase control apparatus of a variable cam timing system is shown, such as the phase control apparatus 300 shown in FIGS. 3-9B and VCT system 200 shown in FIG. 2. Instructions for carrying out method 1100 may be executed by a controller (e.g., controller 12 shown in FIG. 1) based on instructions stored on a memory of the controller and in conjunction with signals received from sensors of the engine system, such as the sensors described above with reference to FIG. 1. The controller may employ engine actuators of the engine system to adjust engine operation, according to the methods described below. For example, the controller may send a signal to a control valve of the phase control actuator to fill or remove hydraulic fluid from a chamber of a housing of the phase control apparatus in order to rotate the vane rotor within the housing, thereby changing a position of a camshaft coupled with the vane rotor, and thus changing the timing of the valves coupled to the camshaft (e.g., opening and closing timing of the intake or exhaust valves).

At 1102, the method includes estimating and/or measuring engine operating conditions. In one example, the engine operating conditions may include engine speed, pedal position, operator torque demand, an engine key-off signal, ambient conditions (ambient temperature, pressure, humidity), engine temperature, manifold air pressure (MAP), manifold air flow (MAF), oil pressure, etc. In other examples, estimating and/or measuring engine operating conditions may include a vehicle controller, such as the example controller 12 shown in FIG. 1, receiving various signals from sensors coupled to the engine. Example signals include signals indicating quantity of inducted mass air flow from a MAF sensor, engine coolant temperature from a temperature sensor, a profile ignition pickup signal (PIP) from a Hall effect sensor coupled to the crankshaft, a throttle position from a throttle position sensor, and an absolute manifold pressure signal from a MAP sensor. Engine speed signal and RPM may be generated by the controller from the PIP signal. Note that various combinations of the above sensors may be used, such as a MAF sensor without a MAP sensor, or vice versa.

In this way, engine operating conditions may be defined in order to, at 1104, adjust cam rotor position according to the current engine operating conditions. As an example, the controller may actuate a control valve, such as one of the example control valves 226 and 228 shown in FIG. 2, to direct oil received from conduits in the engine to a hydraulic chamber within a housing of the phase control apparatus to hydraulically move a vane rotor of the phase control apparatus (coupled to a camshaft) and adjust the phase angle between the crankshaft and the respective camshaft. This adjustment of the phase angle between the crankshaft and a respective camshaft may advance the valve timing, if the rotor of the vane of the phase control apparatus is moved in an advanced direction. Alternately, the adjustment of the phase angle between the crankshaft and a respective camshaft may retard the valve timing if the rotor of the vane of the phase control apparatus is moved in a retarded direction. In one example, the controller may receive a signal from a pedal position sensor indicating that the operator has requested an increase in torque demand by actuating the accelerator pedal (e.g., tip in). Therein, the controller may, based on predetermined mapped data (stored in a memory of the controller) and additional sensor input, actuate a control valve to allow hydraulic fluid to enter the retarded side of the chamber. If the hydraulic fluid on the retarded side of the hydraulic chamber increases to a level greater than the hydraulic fluid on the advanced side of the chamber, the vane may be actuated by the pressure differential to move toward the advanced side of the chamber, thereby advancing the camshaft timing. In another example, the controller may receive a signal from a pedal position sensor indicating that the operator has a very low torque demand as indicated by a decrease in actuation of the accelerator pedal (e.g., cruising). Therein, the controller may, based on predetermined mapped data and additional sensor input, actuate a control valve to allow hydraulic fluid to enter the advanced side of the hydraulic chamber. If the hydraulic fluid on the advanced side of the hydraulic chamber increases to a level greater than the hydraulic fluid on the retarded side of the chamber, the vane may be actuated by the pressure differential to move toward the retarded side of the chamber, thereby retarding the camshaft timing.

At 1106, the method includes determining whether a request to lock the rotor (e.g., vane rotor of the phase control apparatus) has been received. In one example, a request to lock the rotor may be received when the engine is shut down. In another example, a request to lock the rotor may be received at an engine cold start (e.g., upon engine startup when engine temperature is below a threshold temperature) or an engine idle condition. As discussed previously, a locked position is the position where the locking pin of the vane of the rotor is extended from the vane and positioned in the locking pin recess disposed within the cover plate of the phase control apparatus. This may be known as a passive condition, where the relative positions of the rotor and the housing are constrained from rotating with respect to one another any distance greater than the amount of the backlash gap. Conditions such as engine shut down, cold start, and idle are all operating conditions when a passive, locked configuration of the phase control apparatus occurs. The request may include the controller receiving signals from the plurality of engine sensors previously mentioned to lock the rotor. If no request to lock the rotor is received at 1106, then the routine continues adjusting cam rotor position according to engine operating conditions at 1104.

If a request to lock the rotor is received, then at 1108, the method includes rotating the rotor into a retarded cam position wherein a first surface of a vane of the rotor moves into face-sharing contact with a first surface of the housing (e.g., as shown at FIG. 9A). In one example, the vane of the rotor is positioned within a hydraulic chamber of the housing and rotated into the retarded position by hydraulic actuation. For example, the controller may actuate a control valve of the phase control apparatus to allow hydraulic fluid to enter the advanced side of the hydraulic chamber. As the hydraulic fluid on the advanced side of the hydraulic chamber increases to a level greater than the hydraulic fluid on the retarded side of the chamber, the vane is actuated by the pressure differential to move toward the retarded side of the chamber, thereby retarding the camshaft timing. When a request to lock the rotor is received, the controller may actuate the control valve to increase the retarding (e.g., fully retard) the rotor, thereby rotating the rotor until the first surface (e.g. retarded side surface) of the vane comes into face-sharing contact with the first surface (e.g., retarded side surface) of the housing.

At 1110, the method includes moving a locking pin housing within the vane into a locking pin recess disposed in a cover plate coupled to the housing, the locking pin extending from the vane of the rotor, where while the first surface of the vane is in face-sharing contact with the first surface of the housing, a first side of the locking pin is contacting a first side of the recess and a second side of the locking pin is spaced away from a second side of the recess, the first side of the recess arranged proximate to the first surface of the housing (e.g., the first side of the recess arranged closer to the first surface of the housing than the second side of the recess and the first and second sides of the recess arranged opposite one another relative to a center of the recess). In one example, a hydraulic pressure or other actuating force may be exerted on the pin to counteract the biasing force (e.g., spring) urging the pin toward the recess. Moving the locking pin into the locking pin recess may include actuating a solenoid to control a valve to decrease (e.g., discontinue) the hydraulic pressure or other actuating force exerted on the locking pin, thereby allowing dissipation of the hydraulic pressure acting on the locking pin. Therein, a spring, such as the example spring 804 shown in FIG. 8B, configured to exert an axial force on the locking pin, may return the locking pin to a locked position in the locking pin recess, when the actuating force exerted on the locking pin is discontinued.

At 1112, the method includes maintaining a first gap between the first surface of the vane and the first surface of the housing equal to a second gap between the first side of the locking pin and the first side of the locking pin recess (e.g., as shown at FIG. 9B). While the rotor is locked and the locking pin is positioned within the locking pin recess, as a size of the first gap and second gap increase, a size of a third gap formed between the second side of the locking pin and the second side of the locking pin recess may be equivalently decreased. Therein, the second side of the locking pin recess is arranged opposite the first side of the locking pin recess and the second side of the locking pin is arranged opposite the first side of the locking pin.

At 1114, the method includes determining whether a request to unlock the rotor has been received. In one example, a request to unlock the rotor may be received when operating conditions indicate that adjustment (e.g., advancement) of camshaft timing would increase engine performance, such as when the engine is warm and the controller receives a signal indicating the operator has requested an increase in engine torque. In one example, a request to unlock the rotor and advance camshaft timing may be received when the engine temperature or the engine oil temperature is above a predetermined temperature threshold. In another example, a request to unlock the rotor and advance camshaft timing may be received when the engine speed is above a predetermined level. As discussed previously, an unlocked position is the position where the locking pin of the vane of the rotor is retracted from the locking pin recess and within the bore of the cover plate of the phase control apparatus. This may be known as an active condition, wherein the locking pin extending from a rotor vane is decoupled from a locking pin recess disposed in a cover plate coupled to the housing, allowing the rotor to rotate with respect to the housing as controlled by the inflow of hydraulic oil into respective hydraulic chambers of the housing. If a request to unlock the rotor has not been requested, then the method includes continuing to maintain a first gap between the first surface of the vane and the first surface of the housing equal to a second gap between the first side of the locking pin and the first side of the locking pin recess as described in 1112.

If a request to unlock the rotor is received at 1114, then at 1116, the method includes moving the locking pin away from and out of the locking pin recess and rotating the rotor into a desired cam position. As previously described, hydraulic pressure or other actuating force may be selectively introduced or drained to exert a force on the locking pin that may counteract the biasing force (e.g., spring) that urges the pin toward the locking pin recess. In one example, moving the locking pin away from and out of the locking pin recess may include actuating a solenoid to increase the opening of a control a valve to permit entrance of hydraulic fluid into the locking pin recess (e.g., cavity) thereby increasing the hydraulic pressure exerted on the locking pin. Therein, the hydraulic pressure exerted on the locking pin, in a direction opposite the biasing force exerted by the locking pin spring, may increase so that it overcomes the spring force, thereby moving the locking pin into the unlocked position by causing it to slide axially along a bore in the housing, in a direction away from the locking pin recess and toward an inner plate of the phase control apparatus. When the locking pin is decoupled from the locking pin recess, the rotor may be rotated as specified by the controller to a desired cam position, as determined by engine operating conditions. The method then ends.

In this way, a phase control apparatus is provided that may be assembled with a predetermined backlash gap between only a locking pin and locking pin recess of the phase control apparatus. No additional backlash gap (and no overtravel) may be included between the vane of the rotor (including the locking pin) and the housing. As a result, ease of assembly may be increased without the need for complicated tolerance control (e.g., the vane may be positioned all the way against the housing during assembly). Additionally, by eliminating any overtravel between the vane and housing, the locking pin may be more easily engaged with the locking pin recess during a locking operation. Further, component wear between the locking pin and locking pin recess may be reduced (e.g., since the locking pin may be aligned over the locking pin recess due to the housing contacting the vane). The technical effect of positioning the vane against the housing (eliminating overtravel), positioning the locking pin against the recess, and maintain the backlash gap between only the locking pin and the recess includes reducing tolerance variation during assembly, increasing the ease of use and locking of the pin within the recess during operation of the VCT system, and reducing component wear between the locking pin and locking pin recess, thereby reducing NVH and the life of the phase control apparatus.

A method for assembling a phase control apparatus for an engine camshaft comprises positioning a vane of a rotor of the phase control apparatus against a housing of a drive wheel of the phase control apparatus, positioning a locking pin of the vane against a first side of a recess disposed in a cover plate of the phase control apparatus, and maintaining a backlash gap between only the locking pin and a second side of the recess. In a first example of the method, the first side of the recess is arranged opposite the second side of the recess relative to a center of the recess, and the second side of the recess positioned farther away from where the vane is positioned against the housing than the first side of the recess. A second example of the method optionally includes the first example and further includes wherein positioning the locking pin against the first side of the recess may additionally or alternatively include extending the locking pin from the vane into the recess and biasing the locking pin against the first side of the recess and decreasing a gap between the housing and the vane of the rotor to zero. A third example of the method optionally includes one or more of the first and second examples, and further includes running bolts down between the housing and cover plate to fix the cover plate to the housing after positioning the vane of the rotor against the housing and positioning the locking pin against the first side of the recess. A fourth example of the method optionally includes one of more of the first through third examples, and further includes wherein positioning the vane of the rotor of the phase control apparatus against the housing may include eliminating a backlash gap between the housing and the vane of the rotor so that a surface of the housing has face-sharing contact with a surface of the vane of the rotor. A fifth example of the method optionally includes one of more of the first though fourth examples, and further includes wherein positioning the locking pin against the first side of the recess includes extending the locking pin from an aperture disposed in the vane into the recess. A sixth example of the method optionally includes one or more of the first through fifth examples, and further includes coupling the engine camshaft to a center of the rotor and coupling an engine crankshaft to the drive wheel. A seventh example of the method optionally includes one or more of the first through sixth examples, and further includes wherein the locking pin recess has a first width and the locking pin is cylindrical and has a second diameter, the second diameter smaller than the first width.

A method for operating a variable cam timing system comprises: in response to a request to lock rotation of a rotor within a housing of a drive wheel of the VCT system: rotating the rotor into a retarded cam position where a first surface of a vane of the rotor is in face-sharing contact with a first surface of the housing, and moving a locking pin into a locking pin recess disposed in a cover plate coupled to the housing, the locking pin extending from the vane of the rotor, where while the first surface of the vane is in face-sharing contact with the first surface of the housing, a first side of the locking pin is contacting a first side of the recess and a second side of the locking pin is spaced away from a second side of the recess, the first side of the recess arranged proximate to the first surface of the housing. In a first example of the method, the method includes wherein the vane of the rotor is positioned within a hydraulic chamber of the housing and wherein rotating the rotor into the retarded position includes hydraulically actuating the rotor via flowing hydraulic fluid into the hydraulic chamber. A second example of the method optionally includes the first example and further includes while the rotor is locked and the locking pin is positioned within the locking pin recess, maintaining a first gap between the first surface of the vane and the first surface of the housing equal to a second gap between the first side of the locking pin and the first side of the locking pin recess. A third example of the method optionally includes one or more of the first and second examples, and further comprises while the rotor is locked and the locking pin is positioned within the locking pin recess, as a size of the first gap and second gap increase, decreasing a size of a third gap formed between a second side of the locking pin and a second side of the locking pin recess, the second side of the locking pin recess arranged opposite the first side of the locking pin recess and the second side of the locking pin arranged opposite the first side of the locking pin. A fourth example of the method optionally includes one of more of the first through third examples, and further includes wherein in response to a request to unlock rotation of the rotor within the housing, moving the locking pin away from and out of the locking pin recess and rotating the rotor into a desired cam position.

A phase control apparatus for a camshaft is provided, comprising: a drive wheel, a cover plate covering a first side of the drive wheel and including a recess disposed therein, a housing fixed to the drive wheel and positioned between the cover plate and an inner plate of the apparatus, a vane rotor including at least one vane and positioned within the housing, where the at least one vane is positioned in a hydraulic chamber of the housing, and a locking pin positioned within a bore of the at least one vane and movable into a locked position where the locking pin engages the recess and an unlocked position where the locking pin is not positioned within the recess, wherein in the locked position, a first gap between a first surface of the housing and a first surface of the at least one vane is equal to a second gap between a first side of the locking pin and a first side of the recess, wherein a second side of the recess, arranged opposite the first side of the recess, is arranged farther away from the first surface of the housing than the first side of the recess. In a first example of the phase control apparatus, the hydraulic chamber is formed between the first surface of the housing and a second surface of the housing and wherein the vane rotor is movable between a retarded cam positon where the first surface of the at least one vane is arranged proximate to the first surface of the housing and an advanced cam position where a second surface of the at least one vane is arranged proximate to the second surface of the housing. A second example of the phase control apparatus optionally includes the first example and further includes wherein the locking pin is positioned within the at least one vane, between the first surface and second surface of the at least one vane. A third example of the phase control apparatus optionally includes one or more of the first and second examples, and further includes wherein an axis of the locking pin, along which the locking pin moves between the locked position and unlocked position, is parallel to a rotational axis of the drive wheel. A fourth example of the phase control apparatus optionally includes one of more of the first through third examples, and further includes wherein the housing includes a plurality of hydraulic chambers, separated by partitions of the housing and positioned around an outer circumference of the housing and wherein the vane rotor includes a plurality of vanes, each vane positioned within one of the hydraulic chambers. A fifth example of the phase control apparatus optionally includes one of more of the first though fourth examples, and further includes wherein the drive wheel includes an outer, toothed surface adapted to couple with a crankshaft. A sixth example of the method optionally includes one or more of the first through fifth examples, and further includes wherein each of the recess and the locking pin have a circular cross-sectional area.

In a further representation, a phase control apparatus for a camshaft comprises: a drive wheel including an outer, toothed surface, adapted to couple with a crankshaft and an inner housing including a plurality of chambers, each chamber formed between a first housing surface and a second housing surface arranged perpendicular to the outer toothed surface; a rotor positioned within the housing and including plurality of vanes, each vane positioned within one of the plurality of chambers and adapted to move within the chamber; a cover plate coupled to a first side of the housing an including recess disposed in an inner surface of the cover plate; and a locking pin positioned within an aperture of one vane of the plurality of vanes, where an axis of the locking pin is arranged parallel to a rotational axis of the drive wheel, and where the phase control apparatus is movable into a locked configuration. In a first example of the phase control apparatus, for at least one vane of the plurality of vanes, a first surface of the at least one vane is in face-sharing contact with the first housing surface and a second surface of the at least one vane is positioned way from the second housing surface. A second example of the phase control apparatus optionally includes the first example and further includes a first side of the locking pin directly contacting a first side of the recess and a second side of the locking pin positioned away from a second side of the recess.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating a variable cam timing (VCT) system, comprising:

in response to a request to lock rotation of a rotor within a housing of a drive wheel of the VCT system:

rotating the rotor into a retarded cam position where a first surface of a vane of the rotor is in face-sharing contact with a first surface of the housing;

moving a locking pin into a locking pin recess disposed in a cover plate coupled to the housing, the locking pin extending from the vane of the rotor, where, while the first surface of the vane is in face-sharing contact with the first surface of the housing, a first side of the locking pin is contacting a first side of the locking pin recess and a second side of the locking pin is spaced away from a second side of the locking pin recess, the first side of the locking pin recess arranged proximate to the first surface of the housing; and while the rotor is locked and the locking pin is positioned within the locking pin recess, maintaining a first gap between the first surface of the vane and the first surface of the housing equal to a second gap between the first side of the locking pin and the first side of the locking pin recess.

2. The method of claim 1, wherein the vane of the rotor is positioned within a hydraulic chamber of the housing and wherein rotating the rotor into the retarded cam position includes hydraulically actuating the rotor via flowing hydraulic fluid into the hydraulic chamber.

3. The method of claim 1, further comprising, while the rotor is locked and the locking pin is positioned within the locking pin recess, as a size of the first gap and the second gap increases, decreasing a size of a third gap formed between the second side of the locking pin and the second side of the locking pin recess, the second side of the locking pin recess arranged opposite the first side of the locking pin recess and the second side of the locking pin arranged opposite the first side of the locking pin.

4. The method of claim 3, further comprising, in response to a request to unlock rotation of the rotor within the housing, moving the locking pin away from and out of the locking pin recess and rotating the rotor into a desired cam position.

5. A phase control apparatus for a camshaft, comprising:

a drive wheel;

a cover plate covering a first side of the drive wheel and including a recess disposed therein;

a housing fixed to the drive wheel and positioned between the cover plate and an inner plate of the apparatus;

a vane rotor including at least one vane and positioned within the housing, where the at least one vane is positioned in a hydraulic chamber of the housing; and a locking pin positioned within a bore of the at least one vane and movable into a locked position where the locking pin engages the recess and an unlocked position where the locking pin is not positioned within the recess, wherein, in the locked position, a first gap between a first surface of the housing and a first surface of the at least one vane is equal to a second gap between a first side of the locking pin and a first side of the recess, wherein a second side of the recess, arranged opposite the first side of the recess, is arranged farther away from the first surface of the housing than the first side of the recess.

6. The phase control apparatus of claim 5, wherein the hydraulic chamber is formed between the first surface of the housing and a second surface of the housing, and wherein the vane rotor is movable between a retarded cam positon where the first surface of the at least one vane is arranged proximate to the first surface of the housing and an advanced cam position where a second surface of the at least one vane is arranged proximate to the second surface of the housing.

7. The phase control apparatus of claim 6, wherein the locking pin is positioned within the at least one vane, between the first surface and the second surface of the at least one vane.

8. The phase control apparatus of claim 7, wherein an axis of the locking pin, along which the locking pin moves between the locked position and the unlocked position, is parallel to a rotational axis of the drive wheel.

9. The phase control apparatus of claim 5, wherein the housing includes a plurality of hydraulic chambers, separated by partitions of the housing and positioned around an outer circumference of the housing, and wherein the vane rotor includes a plurality of vanes, each vane positioned within one of the plurality of hydraulic chambers.

10. The phase control apparatus of claim 5, wherein the drive wheel includes an outer, toothed surface adapted to couple with a crankshaft.

11. The phase control apparatus of claim 5, wherein each of the recess and the locking pin has a circular cross-sectional area.

* * * * *